US006557349B1

(12) United States Patent
Young et al.

(10) Patent No.: US 6,557,349 B1
(45) Date of Patent: May 6, 2003

(54) METHOD AND APPARATUS FOR INCREASING HEAT TRANSFER FROM COMBUSTORS

(75) Inventors: Craig D. Young, Maineville, OH (US); Eva Z. Lanman, Milford, OH (US); Ronald T. Murach, Mason, OH (US); Bangalore A. Nagaraj, West Chester, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/550,522

(22) Filed: Apr. 17, 2000

(51) Int. Cl.[7] ..... F02C 1/00; F02G 3/00
(52) U.S. Cl. ..... 60/752; 60/756; 60/39.11
(58) Field of Search ..... 60/752, 756, 39.11

(56) References Cited

U.S. PATENT DOCUMENTS 4,916,905 A 4/1990 Havercroft et al. ..... 60/756
5,396,759 A 3/1995 Richardson ..... 60/39.36
5,419,115 A 5/1995 Butler et al. ..... 60/39.36
5,630,319 A 5/1997 Schilling et al.
5,924,288 A 7/1999 Fortuna et al.

*Primary Examiner*—Charles G. Freay
*Assistant Examiner*—W Rodriguez
(74) *Attorney, Agent, or Firm*—Rodney M. Young; Armstrong Teasdale LLP

(57) ABSTRACT

A combustor for a gas turbine engine includes a deflector assembly that enhances heat transfer from the combustor and minimizes low cycle fatigue stresses induced within the combustor. The deflector assembly includes a plurality of deflectors secured to a spectacle plate. Each deflector has tapered edges and includes a plurality of cylindrical projections extending outward from the deflector to facilitate heat transfer. The projections include rounded edges and are arranged in a high density pattern. The deflector is coated with a thermal barrier coating and a bondcoat to minimize exposure to hot combustion gases or flame radiation.

12 Claims, 3 Drawing Sheets

METHOD AND APPARATUS FOR INCREASING HEAT TRANSFER FROM COMBUSTORS

BACKGROUND OF THE INVENTION

This application relates generally to gas turbine engine combustors and, more particularly, to combustor deflectors.

Combustors are used to ignite fuel and air mixtures in gas turbine engines. Known combustors include at least one dome attached to a liner defining a combustion zone. Fuel igniters are attached to the combustor in flow communication with the dome to supply fuel to the combustion zone. Fuel enters the combustor through a deflector attached to a spectacle plate. The deflectors prevents hot combustion gases produced within the combustion zone from impinging upon the spectacle plate.

Various types of deflectors are known and combustors typically include a plurality of deflectors. Known deflectors are rectangular-shaped and bordered with substantially square radial edges. The deflectors include a plurality of hemispherical projections to facilitate heat transfer from the deflector. The projections extend outward from the deflector and are hemispherical in shape. Known deflectors are typically fabricated from Mar-M-509, HS-188, or Hast-X materials to protect the dome from flame radiation. Such deflectors are also coated with an air plasma spray thermal barrier coating.

During operation, the deflector is subjected to extreme oxidation and low cycle fatigue, LCF, stresses as a result of exposure to flame radiation and hot combustion gases produced within the combustion zone. Over time, the thermal barrier coating covering the square radial edges disintegrates and exposes the deflector to potentially damaging hot temperatures and flame radiation. Such exposure may lead to oxidation and LCF cracking, eventual failures of the deflectors, and distress of the spectacle plates, thus, reducing a useful life of the combustor.

BRIEF SUMMARY OF THE INVENTION

In an exemplary embodiment, a combustor for a gas turbine engine includes a deflector assembly that enhances heat transfer from the combustor and minimizes low cycle fatigue stresses induced within the combustor. The combustor deflector assembly includes a plurality of deflectors secured to a spectacle plate. Each deflector has tapered edges and includes a plurality of cylindrical projections extending outward to facilitate heat transfer from the combustor deflector during gas turbine engine operations. The projections include rounded edges and are arranged in a high density pattern. The deflector is coated with a thermal barrier coating and a bondcoat to minimize exposure of the deflector to hot combustion gases and flame radiation produced as a result of fuel burning in the combustor.

During gas turbine engine operation, the combination of the thermal barrier coating and the projections enhances heat transfer from the deflector plate. Such increased heat transfer facilitates reducing the temperature of the deflector, reducing oxidation, and reducing low cycle fatigue. Additionally the deflector is fabricated from a substrate alloy that further reduces oxidation.

DETAILED DESCRIPTION OF THE INVENTION

Figure 1:
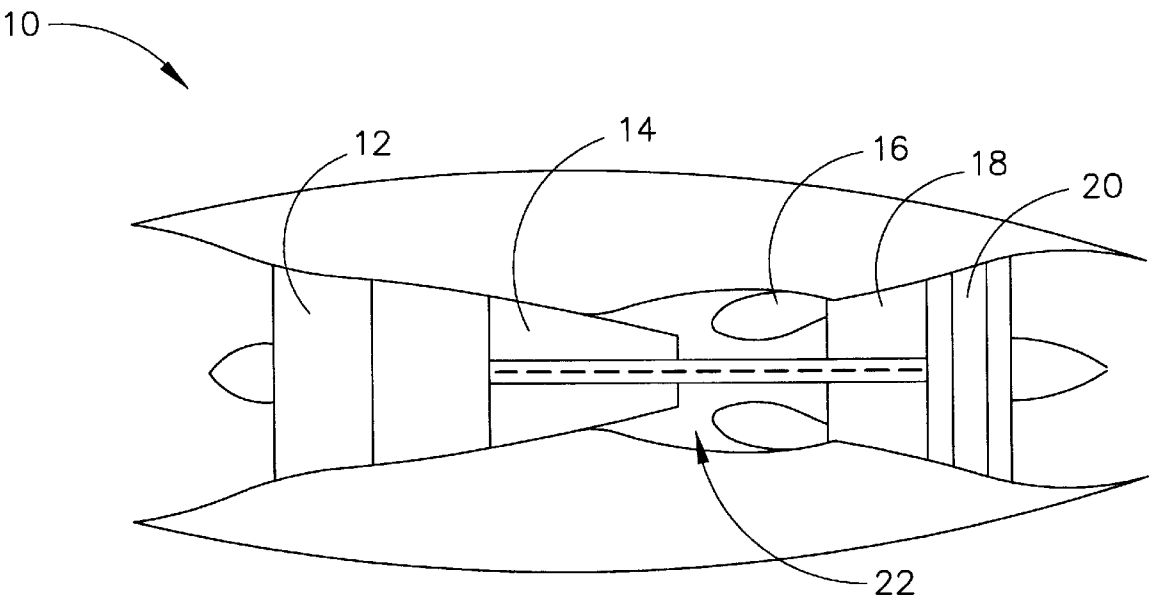
FIG. 1 is schematic illustration of a gas turbine engine including a combustor.

FIG. 1 is a schematic illustration of a gas turbine engine 10 including a low pressure compressor 12, a high pressure compressor 14, and a combustor 16. Engine 10 also includes a high pressure turbine 18 and a low pressure turbine 20. Combustor 16 includes an upstream side 22, and at least one dome (not shown). In one embodiment, the gas turbine engine is a GE-90 engine commercially available from General Electric Company, Cincinnati, Ohio.

In operation, air flows through low pressure compressor 12 and compressed air is supplied from low pressure compressor 12 to high pressure compressor 14. The highly compressed air is delivered to combustor 16. Airflow (not shown in FIG. 1) from combustor 16 drives turbines 18 and 20.

Figure 2:
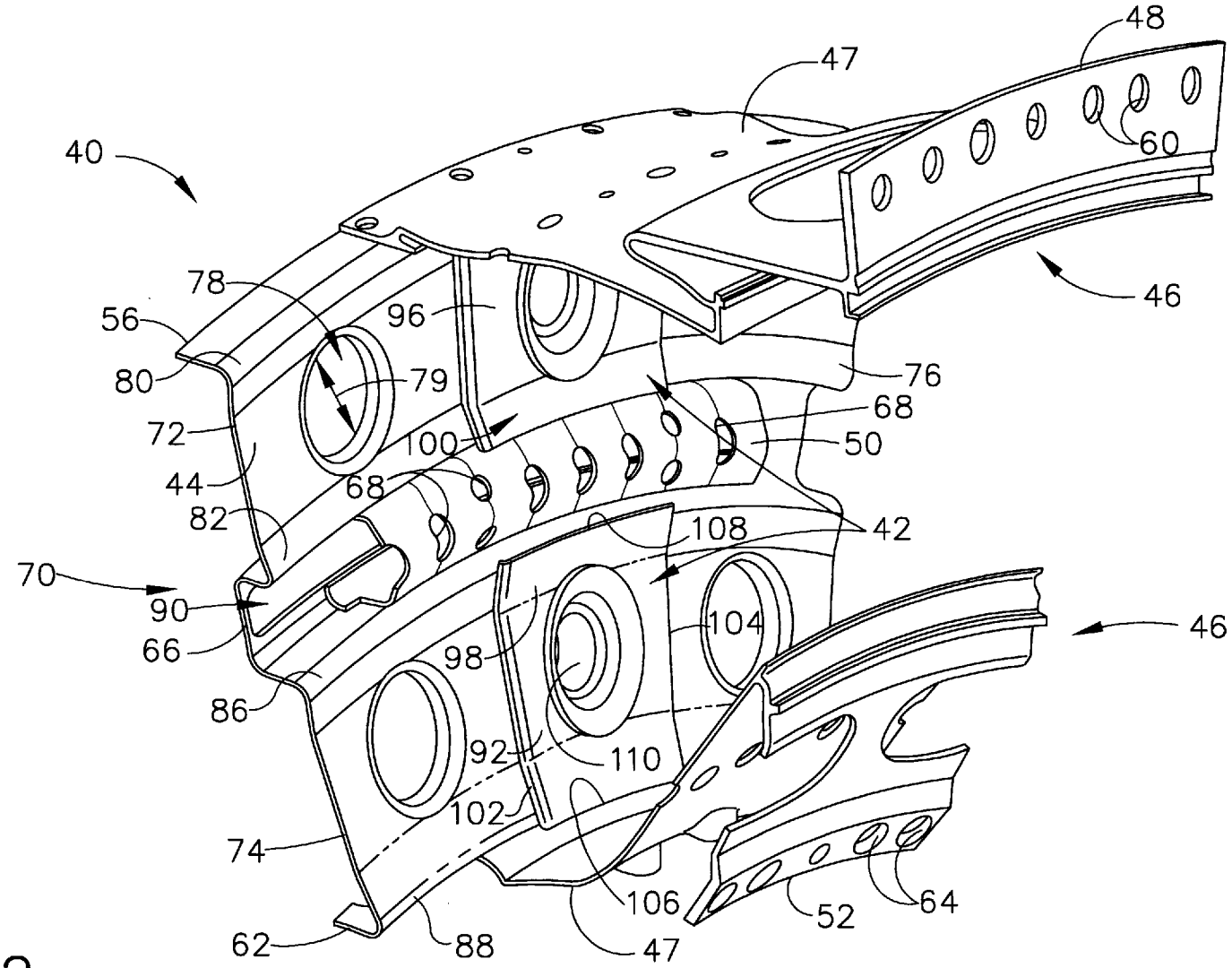
FIG. 2 is a partial perspective view of a downstream side of a deflector assembly used with the combustor shown in FIG. 1 as seen from downstream.

FIG. 2 is a partial perspective view of a deflector assembly 40 used with a combustor 16 (shown in FIG. 1) for a gas turbine engine, such as engine 10 shown in FIG. 1. Deflector assembly 40 is annular and includes a plurality of deflectors 42 and a spectacle plate 44. In one embodiment, spectacle plate 44 is a die formed sheet metal part. A mounting system 46 secures deflector assembly 40 to combustor upstream side 22 (shown in FIG. 1) upstream from a dome (not shown). Mounting system 46 includes a plurality of mounting brackets 47 that include a radial outer flange 48, a mid flange 50, and a radial inner annular flange 52. Flanges 48, 50, and 52 are annular and extend circumferentially from spectacle plate 44. Radial outer flange 48 is secured to an outer rivet band 56 of spectacle plate 44 and includes a plurality of openings 60 sized to receive a plurality of fasteners (not shown) to secure spectacle plate 44 to an outer combustor liner (not shown). Radial inner flange 52 is secured to an inner rivet band 62 of spectacle plate 44 and includes a plurality of openings 64 sized to receive a plurality of fasteners (not shown) to secure spectacle plate 44 to an inner combustor liner (not shown). The outer and inner combustor liners define a combustion zone (not shown) within combustor 16. Mid flange 50 extends from a center channel 66 of spectacle plate 44 and includes a plurality of openings 68 to permit airflow to pass through spectacle plate 44.

Spectacle plate 44 includes a body 70 having a radial outer portion 72 and a radial inner portion 74. Spectacle plate body 70 is unitary and also includes a downstream side 76 and an upstream side (not shown). Radial outer portion 74 extends between support frame outer rivet band 56 and center channel 66 and includes a plurality of openings 78 sized to receive a fuel injector nozzle (not shown). Radial inner portion 74 extends between center channel 66 and inner rivet band 62, and also includes plurality of openings 78. Openings 78 have a diameter 79 sized to receive a fuel injector nozzle (not shown). Openings 79 are sized equally to radial inner portion openings 78.

A pair of annular beveled corner pieces 80 and 82 are identical and extend circumferentially from body radial outer portion 72. Specifically, beveled corner piece 80 extends downstream from radial outer portion 82 and connects outer rivet band 56 to body radial outer portion 82 such that outer rivet band 56 extends substantially perpendicularly upstream from body radial outer portion 72. Furthermore, beveled corner piece 82 extends downstream from radial outer portion 72 and connects center channel 66 to body radial outer portion 72 such that center channel 66 extends substantially perpendicularly upstream from radial outer portion 72.

Another pair of annual beveled corner pieces 86 and 88 identical to each other and to corner pieces 80 and 82. Corner pieces 86 and 88 extend circumferentially from body radial inner portion 74. Specifically, beveled corner piece 88 extends downstream from radial inner portion 74 and connects inner rivet band 62 to body radial inner portion 74 such that inner rivet band 62 extends substantially perpendicularly upstream from body radial inner portion 74. Furthermore, beveled corner piece 86 extends downstream from radial inner portion 74 and connects center channel 66 to body radial inner portion 74 such that center channel 66 also extends substantially perpendicularly upstream from radial inner portion 74.

Center channel 66 extends between radial outer portion 72 and radial inner portion 74 and includes a plurality of openings 90. Openings 90 permit airflow to pass through spectacle plate 44.

Deflectors 42 are disposed on spectacle plate body 70 and are anchored to both body radial outer and inner portions 72 and 74, respectively. In one embodiment, deflectors 42 are brazed to spectacle plate body 70. Deflectors 42 include a downstream side 92 and an upstream side (not shown in FIG. 2). The deflector upstream side and downstream side 92 are substantially parallel to each other and deflectors 42 are attached to spectacle plate body 70 such that the deflector upstream side is adjacent either spectacle plate body 70. More specifically, deflectors 42 are attached to both spectacle plate body radial outer and inner portions 72 and 74, respectively.

Deflectors 42 are substantially rectangular and include a body 96 and a pair of edge areas 98 and 100. Body 96 extends radial between substantially parallel radial edges 102 and 104, and circumferentially between substantially parallel flare edges 106 and 108. Radial edges 102 and 104 and flare edges 106 and 108 are rounded. Edge areas 98 and 100 extend between radial edges 102 and 104 and are adjacent flare edges 106 and 108. Edges areas 98 and 100 extend from deflector body 96 at an angle (not shown) approximately equal an angle of beveling of corner pieces 80, 82, 86, and 88. Accordingly, when each deflector 42 is secured to spectacle plate body 70, edge areas 98 and 100 are secured flush against spectacle plate body 70. Deflectors 42 also includes an cylindrical sleeve (not shown in FIG. 2). The cylindrical sleeve includes an opening 110 sized to fit concentrically through spectacle plate body openings 78 when deflectors 42 are attached to spectacle plate 44.

Deflector 42 is fabricated from a superalloy substrate and coated with thermal barrier coating (not shown) to reduce thermal exposure when gas turbine engine 10 is operating. Physical vapor deposition thermal barrier coating, TBC, is applied to deflector 42 and provides thermal protection to deflector 42 to minimize low cycle fatigue, LCF, failures of deflector 42. In one embodiment, deflector 42 is fabricated from a superalloy substrate Rene N5 available from Howmat Whitehall Casting, Whitehall, Mich. An oxidation resistant bondcoat is applied to deflector 42 beneath a layer of TBC to extend a useful life of deflector 42. In one embodiment, the oxidation resistant bondcoat is platinum aluminide.

During operation of gas turbine engine 10, deflector 42 protects spectacle plate 44 from hot gases and flame radiation generated within a combustion zone (not shown) of combustor 16. The thermal barrier coating reduces low cycle fatigue within deflector 42 and prevents deflector radial edges 102 and 104 and deflector flare edges 106 and 108 from cracking caused as a result of prolonged exposure to flame radiation and hot combustion gases. The platinum aluminide provides additional protection to the substrate alloy used to fabricate deflector 42 against corrosion and thus, extends the life of deflector 42.

Figure 3:
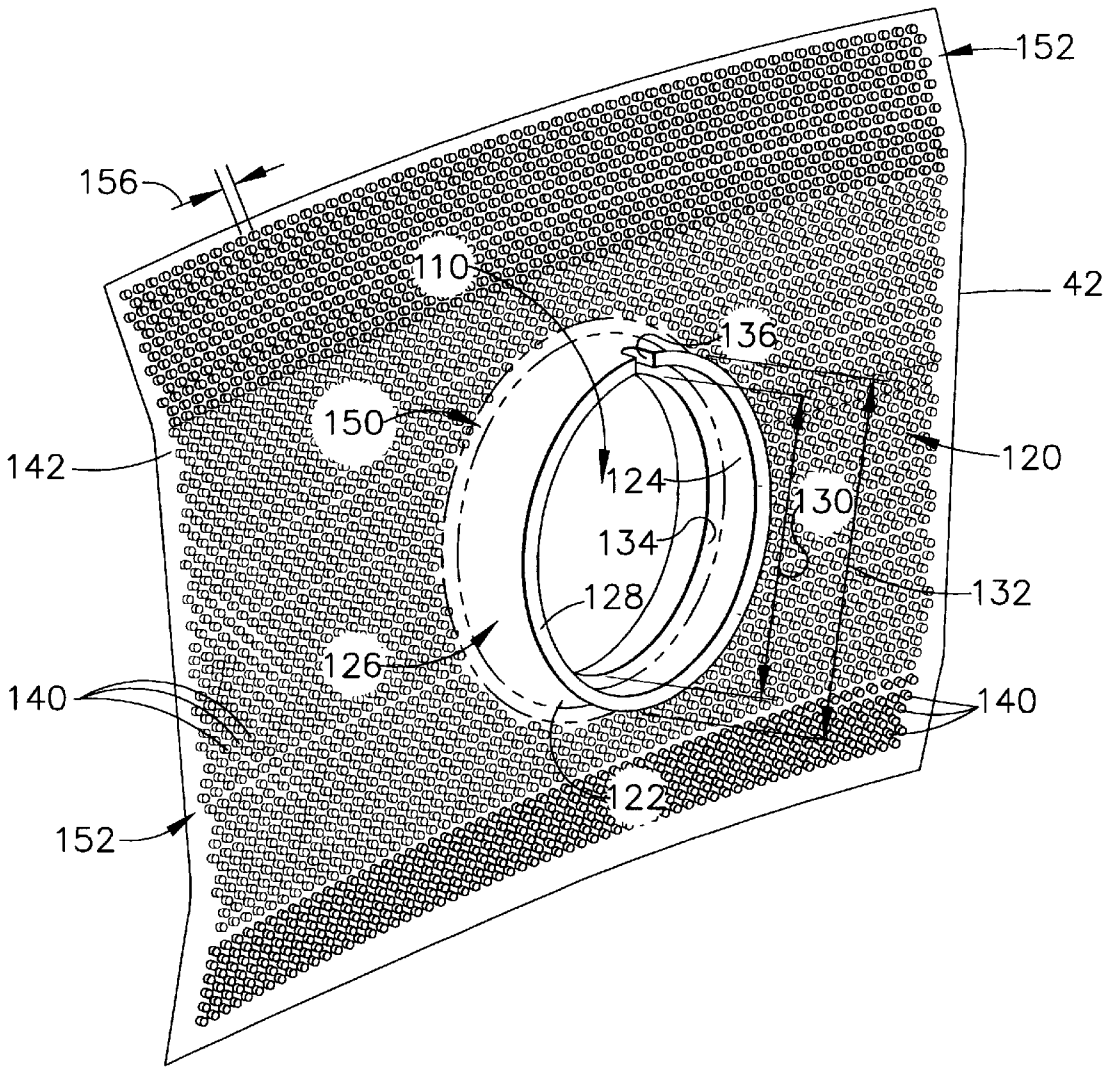
FIG. 3 is a partial perspective view of an upstream side of the deflector assembly shown in FIG. 2 as seen from upstream.

FIG. 3 is a perspective view of an upstream side 120 of deflector 42. A cylindrical sleeve 122 extends upstream from upstream side 120 of deflector 42. Cylindrical sleeve 122 includes an inner surface 124 and an outer surface 126. Cylindrical sleeve 122 extends substantially perpendicularly upstream from deflector spectacle plate body 70 to an upstream edge 128. Inner surface 124 defines an inner diameter 130 for opening 110 and outer surface 126 defines an outer diameter 132. Inner diameter 130 is sized to receive a fuel injector nozzle (not shown). Inner surface 124 includes a stop 134 that extends radially inward circumferentially from inner surface 124. Stop 134 and a notch 136 limit a distance that the fuel injector nozzle may be inserted within deflector 42. Notch 136 extends from cylindrical sleeve outer surface 126 to inner surface 124, and from cylindrical sleeve upstream edge 128 towards deflector body 96.

Outer diameter 128 is sized slightly smaller than spectacle plate opening diameters 79 (shown in FIG. 2). Accordingly, when deflector 42 is secured to spectacle plate 44 (shown in FIG. 2), deflector cylindrical sleeve outer surface 126 circumferentially contacts spectacle plate openings 78.

Deflector 42 includes a plurality of projections 140 extending outward from deflector body 96 on deflector upstream side 120. Projections 140 are arranged in a high density pattern 142 extending over deflector body 96 between radial edges 102 and 104. Projections 140 also extend between deflector flare edges 106 and 108 and over edge areas 98 and 100. Projection 140 also extend radially outward from a circumferential clearance 150 surrounding cylindrical sleeve 122 to define an edge clearance 152. Edge clearance 152 circumscribes deflector 42 and edge clearance 152 and circumferential clearance 150 provide areas for deflector 42 to be brazed to spectacle plate 42.

Within high density pattern 142, a center (not shown) of adjacent projections 140 are a distance 156 apart. Distance 156 creates spacing within high density pattern 142 that increases a surface area of upstream side 120 of deflector body 96. Distance 156 is approximately equal three times a height (not shown in FIG. 3) of each projection 140. Distance 156 is also approximately equal three times a radius( not shown in FIG. 3) of each projection 140.

In operation, spacing between adjacent projections 140 increases the surface area of upstream side 120 of deflector body 96. As a temperature of deflector 42 rises as a result of exposure to hot gases within a combustion zone (not shown) of combustor 16 (shown in FIG. 1), heat transfer from deflector 42 is enhanced through projections 142 and is increased in comparison to deflectors 42 that do not include projections 142 arranged in high density pattern 142. As a result of improved heat transfer, material temperatures of deflector 42 are lowered.

Figure 4:
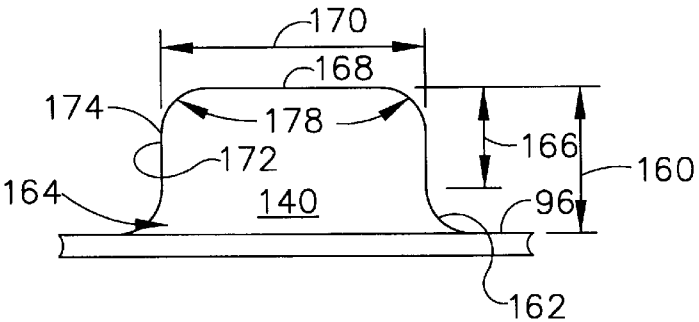
FIG. 4 is an enlarged cross-sectional view of a deflector projection included with the deflector shown in FIG. 3.

FIG. 4 is an enlarged cross-sectional view of a deflector projection 140. Projections 140 are known as bumps or enhancements and are cylindrical and extend from deflector body 96 a distance 160. Projections 140 include fillets 162 extending circumferentially around a base 164 of projections 140. A height 166 of each projection 140 is measured between a top surface 168 of each projection 140 and fillets 162. In one embodiment, distance 160 is approximately 0.017 inches, fillets 162 are sized with an approximately 0.005 inch radius, and projection height 168 is approximately 0.015 inches.

Each projection 140 also includes a diameter 170 measured with respect to an outer surface 172 of a side wall 174 circumferentially surrounding projection 140. In one embodiment, diameter 170 is approximately 0.030 inches. Side wall 174 is tapered with fillets 162 adjacent projection base 168 and includes a rounded upper edge 178 with an approximately 0.005 inch radius extending between side wall 174 and projection top surface 168. During engine operation, tapered fillets 162 and rounded upper edge 178 reduce radiation loads induced on projections 140 in comparison to projections that do not include fillets 162 and rounded upper edge 178. As a result, heat transfer from deflector projections 140 is improved and material temperatures of deflector 142 (shown in FIGS. 2 and 3) is lowered.

The above-described combustor for gas turbine engine is cost-effective and highly reliable. The combustor includes a deflector assembly that includes a plurality of deflectors. Each deflector includes a plurality of projections that extend outward from the deflector and facilitate heat transfer from the combustor deflector during gas turbine engine operations. Because the projections are arranged in a high density pattern and the deflector is coated with a thermal barrier coating, heat transfer from the deflector plate is enhanced. As a result of the increased heat transfer, the deflector operates at a lower temperature. As a result of the thermal barrier coating, oxidation and low cycle fatigue are reduced within the deflector. Thus, a combustor deflector is provided which operates at a lower temperature and with an improved lifecycle.

While the invention has been described in terms of various specific embodiments, those skilled in the art will recognize that the invention can be practiced with modifications within the spirit and scope of the claims.

What is claimed is:

1. A combustor for a gas turbine engine comprising:

at least one dome; and a deflector attached to said dome and in flow communication with said dome, said deflector comprising a plurality of cylindrical projections configured to facilitate heat transfer from said combustor, said deflector further comprising an upstream side and an opposite downstream side, said cylindrical projections extending from said deflector upstream side, such that said projections are between said deflector downstream side and said dome, said combustor deflector coated with a thermal barrier coating.

2. A combustor in accordance with claim 1 wherein each of said plurality of cylindrical projections comprises tapered and rounded edges.

3. A combustor in accordance with claim 1 wherein said plurality of cylindrical projections arranged in a high density pattern.

4. A combustor in accordance with claim 3 wherein each of said cylindrical projections comprises a radius, said adjacent cylindrical projections within said high density pattern separated by a distance equal approximately three times said cylindrical projection radius.

5. A combustor in accordance with claim 3 wherein each of said cylindrical projections comprises a height, said adjacent cylindrical projections within said high density pattern separated by a distance equal approximately three times said cylindrical projection height.

6. A combustor in accordance with claim 1 wherein said combustor deflector is further coated with a bondcoat material.

7. A gas turbine engine comprising a combustor comprising a deflector and at least one dome, said deflector attached in flow communication to said dome and comprising a plurality of cylindrical projections configured to facilitate heat transfer from said combustor, said deflector further comprising an upstream side and an opposite downstream side, said cylindrical projections extending from said deflector upstream side, such that said projections are between said deflector downstream side and said dome, said combustor deflector coated with an thermal barrier coating.

8. A gas turbine engine in accordance with claim 7 wherein each of said plurality of projections comprises tapered and rounded edges.

9. A gas turbine engine in accordance with claim 7 wherein said combustor deflector further coated with a bondcoat material.

10. A gas turbine engine in accordance with claim 7 wherein said combustor plurality of cylindrical projections arranged in a high density pattern.

11. A gas turbine engine in accordance with claim 7 wherein said combustor plurality of cylindrical projections comprise a height, said projections arranged in a high density pattern such that adjacent said projections are separated by a distance equal approximately three times said projection height.

12. A gas turbine engine in accordance with claim 7 wherein said combustor plurality of cylindrical projections comprise a radius, said projections arranged in a high density pattern such that adjacent said projections are separated by a distance equal approximately three times said projection radius.

* * * * *